US008221559B2

(12) United States Patent
Inbe et al.

(10) Patent No.: US 8,221,559 B2
(45) Date of Patent: Jul. 17, 2012

(54) METAL SURFACE TREATMENT LIQUID FOR CATION ELECTRODEPOSITION COATING

(75) Inventors: Toshio Inbe, Tokyo (JP); Hiroshi Kameda, Tokyo (JP); Thomas Kolberg, Heppenheim (DE)

(73) Assignee: Nippon Paint Co., Ltd., Osaka (JP)

( * ) Notice: Subject to any disclaimer, the term of this patent is extended or adjusted under 35 U.S.C. 154(b) by 1155 days.

(21) Appl. No.: 12/077,464

(22) Filed: Mar. 19, 2008

(65) Prior Publication Data

US 2008/0230395 A1 Sep. 25, 2008

Related U.S. Application Data

(63) Continuation of application No. PCT/JP2007/074537, filed on Dec. 20, 2007.

(30) Foreign Application Priority Data

Dec. 20, 2006 (JP) ..... 2006-343622
Nov. 22, 2007 (JP) ..... 2007-303745

(51) Int. Cl.
*C23C 10/02* (2006.01)
*C25D 13/12* (2006.01)

(52) U.S. Cl. ..... 148/247; 148/251; 148/261; 204/486

(58) Field of Classification Search ..... 148/247, 148/251, 259, 261; 204/486
See application file for complete search history.

(56) References Cited

U.S. PATENT DOCUMENTS

| | | | | |
|---|---|---|---|---|
| 5,449,415 | A * | 9/1995 | Dolan | 148/259 |
| 6,758,916 | B1 * | 7/2004 | McCormick | 148/251 |
| 2007/0272900 | A1 * | 11/2007 | Yoshida et al. | 252/387 |

FOREIGN PATENT DOCUMENTS

| | | | |
|---|---|---|---|
| JP | 05-195246 | | 8/1993 |
| JP | 2004-218073 | | 8/2004 |
| JP | 2004-218074 | | 8/2004 |
| WO | WO 2006/062037 | * | 6/2006 |

* cited by examiner

*Primary Examiner* — Kishor Mayekar
(74) *Attorney, Agent, or Firm* — Dilworth & Barrese, LLP.

(57) ABSTRACT

A surface treatment with a zirconium ion that enables sufficient throwing power and superior anti-corrosion properties to be exhibited when thus surface treated metal base material is subjected to cation electrodeposition coating is provided. A metal surface treatment liquid thereof for cation electrodeposition coating includes zirconium ions, copper ions, and other metal ions, and having a pH of 1.5 to 6.5, in which: the other metal ions are at least one selected from the group consisting of tin ions, indium ions, aluminum ions, niobium ions, tantalum ions, yttrium ions and cerium ions; the concentration of zirconium ions is 10 to 10,000 ppm; the concentration ratio of the copper ions to the zirconium ions is 0.005 to 1 on a mass basis; and the concentration ratio of the other metal ions to the copper ions is 0.1 to 1,000 on a mass basis.

4 Claims, 1 Drawing Sheet

METAL SURFACE TREATMENT LIQUID FOR CATION ELECTRODEPOSITION COATING

CROSS-REFERENCE TO RELATED APPLICATION(S)

The present application is a continuation of PCT application no. PCT/JP2007/074537 filed Dec. 20, 2007.

TECHNICAL FIELD

The present invention relates to a metal surface treatment liquid, particularly to a metal surface treatment liquid suited for cation electrodeposition coating, and a method of metal surface treatment.

BACKGROUND ART

In order to impart anti-corrosion properties to various metal base materials, surface treatments have thus far been performed. Particularly, a zinc phosphate treatment has been generally employed on metal base materials which constitute automobiles. However, this zinc phosphate treatment has a problem of sludge generation as a by-product. Accordingly, a surface treatment without use of zinc phosphate for a next generation has been demanded, and a surface treatment with zirconium ion is one of such treatments (see, for example, Patent Document 1).

Meanwhile, metal base materials which constitute automobiles and necessitate high anti-corrosion properties are subjected to cation electrodeposition coating following the surface treatment. The cation electrodeposition coating is carried out on the grounds that the coated film obtained by cation electrodeposition coating has superior in anti-corrosion properties, and it has "throwing power", generally referred to, that is a property of allowing automobile bodies having a complicated shape to be completely coated.

However, it has been recently proven that when a metal base material that had been surface treated with the zirconium ion is subjected to cation electrodeposition coating, there may be a case in which the throwing power is not significantly achieved depending on the type thereof. In particular, such a tendency has been revealed to be marked in the case of cold-rolled steel plates. Accordingly, when the cation electrodeposition coating is carried out, sufficient anti-corrosion properties cannot be attained unless throwing power is exhibited.

Patent Document 1: Japanese Unexamined Patent Application, First Publication No. 2004-218070

DISCLOSURE OF THE INVENTION

Problems to be Solved by the Invention

An object of the present invention is to provide a surface treatment with a zirconium ion that enables sufficient throwing power and exhibits superior anti-corrosion properties, when thus surface treated metal base material is subjected to cation electrodeposition coating.

Means for Solving the Problems

In an aspect of the present invention, the metal surface treatment liquid for cation electrodeposition coating is a chemical conversion treatment liquid which contains a zirconium ion, a copper ion, and other metal ion, and has a pH in the range of 1.5 to 6.5, in which: the other metal ion is at least one selected from the group consisting of a tin ion, an indium ion, an aluminum ion, a niobium ion, a tantalum ion, an yttrium ion and a cerium ion; the zirconium ion is included at a concentration of 10 to 10,000 ppm; the concentration ratio of the copper ion to the zirconium ion being 0.005 to 1 on mass basis; and the concentration ratio of the other metal ion to the copper ion being 0.1 to 1,000 on mass basis. Additionally, a polyamine compound, a fluorine ion, and a chelate compound may be further included. When the fluorine ion is included, the amount of free fluorine ion at a pH of 3.0 may be 0.1 to 50 ppm.

The method of metal surface treatment of the present invention includes a step of subjecting a metal base material to a surface treatment with the abovementioned metal surface treatment liquid. A coating film obtained by the surface treatment is formed on the surface treated metal base material of the present invention. The method of cation electrodeposition coating of the present invention includes a step of subjecting a metal base material to a surface treatment with the abovementioned metal surface treatment liquid, and a step of subjecting the surface treated metal base material to cation electrodeposition coating. The metal base material coated by the cation electrodeposition of the present invention is obtained by the abovementioned method of coating.

Effects of the Invention

According to the metal surface treatment liquid for cation electrodeposition coating of the present invention, it is believed that throwing power is exhibited when cation electrodeposition coating is conducted through including a copper ion and other metal ion in addition to the zirconium ion. Although not clarified, the grounds are conceived as follows.

When zirconium ions are used alone, formation of their oxide coating film is believed to be executed simultaneously with etching of the metal base material in an acidic medium. However, since segregation products and the like of silica may be present on cold-rolled steel plates, such parts are not susceptible to etching. Therefore, the coating film cannot be uniformly formed with zirconium oxide, whereby portions without coating film formation can be present. Since the difference in electric current flow is generated between the portions with and without formation of the coating film, it is believed that the electrodeposition is not uniformly executed, and consequently the throwing power cannot be attained.

Meanwhile, an electron micrograph of the coating film obtained by the metal surface treatment liquid for cation electrodeposition coating of the present invention shows deposition of copper observed in a scattered manner. The copper ion is apparently more apt to be deposited on the base material compared with the zirconium ion. It is believed that a zirconium oxide coating film is first formed on the parts where the copper was deposited in a scattered manner. Although merely a speculation, it is believed that the throwing power is improved not by just forming the coating film, but by causing some interaction of zirconium with copper to form a coating film having a resistance that enables generation of Joule heat in electrodeposition such as zinc phosphate, thereby allowing the electrodeposition coating film to flow by the Joule heat. In addition, other metal ions, having deposition properties related to copper and zirconium, are believed to be effective in preventing copper from excessive deposition with respect to zirconium.

The metal surface treatment liquid for cation electrodeposition coating of the present invention can improve adhesiveness to the coated film by cation electrodeposition through including the polyamine compound, and consequently, it can pass SDT test under more stringent conditions. In addition, the metal surface treatment liquid for cation electrodeposition coating of the present invention can improve anti-corrosion properties by including copper ions. Although the grounds are not clarified, it is believed that some interaction may be caused between copper and zirconium in forming the coating film. Furthermore, the metal surface treatment liquid for cation electrodeposition coating of the present invention can form a zirconium oxide coating film in a stable manner by including a chelate compound when a metal other than zirconium is included in large quantity. This occurrence is believed to result from capture by the chelate compound of copper and other metal ions that are more apt to be deposited than zirconium.

PREFERRED MODE FOR CARRYING OUT THE INVENTION

Figure 1:
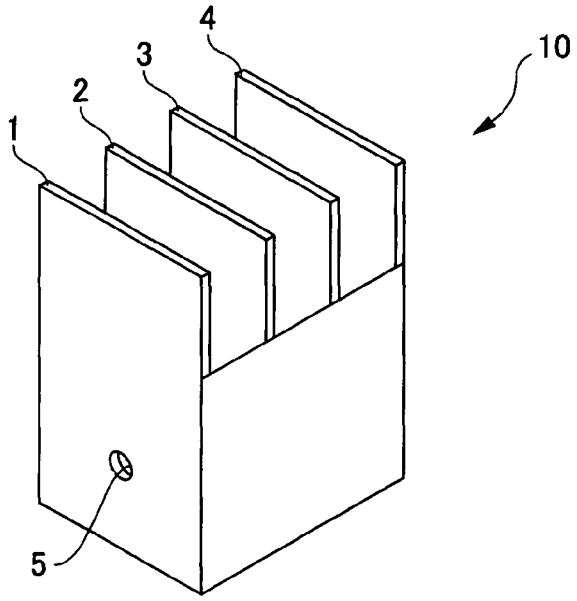
FIG. 1 shows a perspective view illustrating one example of the box for use in evaluating the throwing power.
Figure 2:
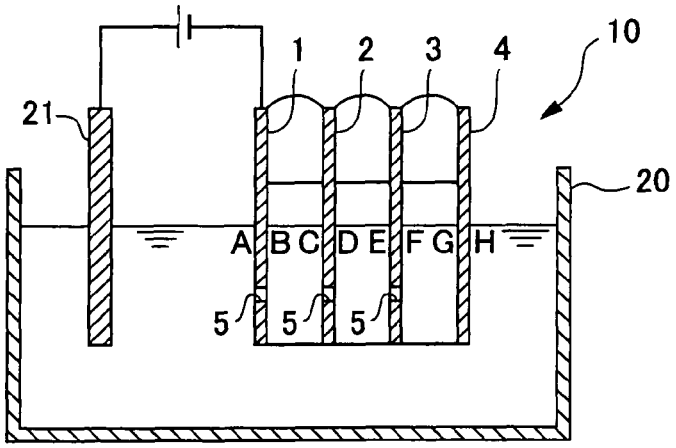
FIG. 2 shows a view schematically illustrating evaluation of the throwing power.

The metal surface treatment liquid for cation electrodeposition coating of the present invention includes zirconium ions, copper ions, and other metal ions.

The zirconium ions are included at a concentration in the range of 10 to 10,000 ppm. When the concentration is less than 10 ppm, sufficient anti-corrosion properties cannot be achieved since deposition of the zirconium coating film is not enough. In addition, even though the concentration may exceed 10,000 ppm, an effect to justify the amount cannot be exhibited since the deposition amount of the zirconium coated film is not increased, and adhesiveness of the coated film may be deteriorated, thereby leading to inferior anti-corrosion performance such as those in SDT. The lower limit and the upper limit of the concentration are preferably 100 ppm and 500 ppm, respectively.

The concentration of the metal ions herein, when a complex or oxide thereof was formed, is represented by the concentration based on the metal element, taking into account only of the metal atom in the complex or oxide. For example, the concentration based on the metal element of zirconium of a 100 ppm complex ions $ZrF_6^{2-}$ (molecular weight: 205) is calculated to be 44 ppm by the formula of 100×(91/205).

With respect to the amount of the copper ions included in the metal surface treatment liquid for cation electrodeposition coating of the present invention, the concentration ratio to the zirconium ions is 0.005 to 1 on a mass basis. When the ratio is less than 0.005, the intended effect, i.e. an effect of improving the throwing power by deposition of copper, cannot be exhibited. In contrast, when the ratio exceeds 1, deposition of zirconium may be difficult. More preferable, the upper limit is 0.2. However, when the total amount of the zirconium ions and copper ions is too small, the effect of the present invention may not be exhibited. Therefore, the total concentration of the zirconium ions and the copper ions in the metal surface treatment liquid of the present invention is preferably no less than 12 ppm.

The content of the copper ions is preferably from 0.5 to 100 ppm. When the content is less than 0.5 ppm, the deposition amount of copper is so small that the throwing power is not significantly improved. When the content exceeds 100 ppm, deposition of the zirconium coating film may be difficult, whereby the anti-corrosion properties and the coating appearance are likely to be inferior. The lower limit and the upper limit are more preferably 5 ppm and 50 ppm, respectively.

As the other metal ions which may be included in the metal surface treatment liquid for cation electrodeposition coating of the present invention, tin ions, indium ions, aluminum ions, niobium ions, tantalum ions, yttrium ions, and cerium ions can be exemplified. Among these, tin ions, indium ions, and aluminum ions are preferred in light of the ease of deposition as a metal oxide, and tin ions are particularly preferred in light of a further improvement in anti-corrosion properties such as those in SDT. The tin ions are preferably bivalent cations. Two or more of these can be used in combination.

In particular, the content of the tin ions is preferably in the range of 5 to 200 ppm. When the content is less than 5 ppm, an improvement in the anti-corrosion properties is not significantly achieved by adding the tin ions. When the content is above 200 ppm, deposition of the zirconium coating film may be difficult, whereby the anti-corrosion properties and the coating appearance are likely to be inferior. The upper limit of the tin ion content is more preferably 100 ppm, still more preferably 50 ppm, and most preferably 25 ppm.

Furthermore, as the other metal ions, since the aluminum ions and/or the indium ions can function similarly to the tin ions, these can be used in combination with or without the tin ions. Of these, aluminum is more preferred. The content of the aluminum ions and/or the indium ions is preferably in the range of 10 to 1,000 ppm, more preferably in the range of 50 to 500 ppm, and still more preferably in the range of 100 to 300 ppm. When the content of the aluminum ions and/or the indium ions is less than 10 ppm, excessive deposition of copper is not significantly prevented. When the content exceeds 1,000 ppm, deposition of the zirconium coating film may be difficult, and the anti-corrosion properties and the coating appearance are likely to be inferior.

From the foregoing, exemplary metal surface treatment liquids for cation electrodeposition coating of the present invention include, for example, the metal surface treatment liquids for cation electrodeposition coating which contain zirconium ions, copper ions, and tin ions; the metal surface treatment liquids for cation electrodeposition coating which contain zirconium ions, copper ions, and aluminum ions; and the metal surface treatment liquids for cation electrodeposition coating which contain zirconium ions, copper ions, tin ions, and aluminum ions. These metal surface treatment liquids for cation electrodeposition coating can further include fluorine as described later. In addition, these metal surface treatment liquids for cation electrodeposition coating can further include a polyamine compound and sulfonic acid as described later.

The concentration ratio of the other metal ions to the copper ions is in the range of 0.1 to 1,000 on a mass basis. When the ratio is less than 0.1, the copper may be excessively deposited with respect to zirconium. In contrast, when the ratio is above 1,000, the metal ions itself may be excessively deposited, whereby deposition of zirconium may be inhibited. The lower limit and the upper limit are more preferably 0.3 and 100, respectively. Still more preferably, the upper limit is 10. When there exist two or more kinds of the other metal ions, the concentration of the other metal ions indicates the total concentration thereof.

The metal surface treatment liquid for cation electrodeposition coating of the present invention has a pH in the range of 1.5 to 6.5. When the pH is less than 1.5, the metal-base material cannot be sufficiently etched to decrease the coating film amount, and sufficient anti-corrosion properties cannot be achieved. In addition, the stability of the treatment liquid may not be sufficient. In contrast, when the pH is higher than 6.5, excessive etching may lead to failure in formation of sufficient coating film, or an un-uniform adhesion amount and film thickness of the coating film may adversely affect the coating appearance and the like. The lower limit and the upper limit of pH are preferably 2.0 and 5.5, and still more preferably 2.5 and 5.0, respectively, and they are particularly preferably the pH of 3.0 and 4.0.

The metal surface treatment liquid for cation electrodeposition coating of the present invention may further include a polyamine compound for improving adhesiveness to the coated film by cation electrodeposition which is formed after the surface treatment. The polyamine compound used in the present invention is believed to be fundamentally significant in being an organic molecule having an amino group. Although speculative, the amino group is believed to be incorporated in the metal coating film by a chemical action with zirconium oxide deposited as a coating film on the metal base plate, or with the metal plate. Moreover, the polyamine compound that is an organic molecule is responsible for adhesiveness with the coated film provided on the metal plate having the coating film formed thereon. Therefore, when the polyamine compound that is an organic molecule having an amino group is used, it is believed that adhesiveness between the metal base plate and the coated film is significantly improved, and superior corrosion resistance can be attained. Examples of the polyamine compound include hydrolysis condensates of aminosilane, polyvinylamine, polyallylamine, water soluble phenolic resins having an amino group, and the like. Since the amount of amine can be freely adjusted, the hydrolysis condensate of aminosilane is preferred. Therefore, exemplary metal surface treatment liquids for cation electrodeposition coating of the present invention include, for example, the metal surface treatment liquids for cation electrodeposition coating which include zirconium ions, copper ions, other metal ions, and a hydrolysis condensate of aminosilane; the metal surface treatment liquids for cation electrodeposition coating which contain zirconium ions, copper ions, other metal ions, and polyallylamine; and the metal surface treatment liquids for cation electrodeposition coating which include zirconium ions, copper ions, other metal ions, and a water soluble phenolic resin having an amino group. In this case, aluminum ions and/or tin ions are preferably used as the other metal ions. Additionally, fluorine, as described later, may be also included.

The hydrolysis condensate of aminosilane is obtained by carrying out hydrolysis condensation of an aminosilane compound. Examples of the aminosilane compound include vinyltrichlorosilane, vinyltrimethoxysilane, vinyltriethoxysilane, 2-(3,4 epoxycyclohexyl)ethyltrimethoxysilane, 3-glycidoxypropyltrimethoxysilane, 3-glycidoxypropylmethyldiethoxysilane, 3-glycidoxypropyltriethoxysilane, p-styryltrimethoxysilane, 3-methacryloxypropylmethyldimethoxysilane, 3-methacryloxypropyltrimethoxysilane, 3-methacryloxypropylmethyldiethoxysilane, 3-methacryloxypropyltriethoxysilane, 3-acryloxypropyltrimethoxysilane, N-2(aminoethyl)-3-aminopropylmethyldimethoxysilane, N-2(aminoethyl)-3-aminopropyltrimethoxysilane, N-2 (aminoethyl)-3-aminopropyltriethoxysilane, 3-aminopropyltrimethoxysilane, 3-aminopropyltriethoxysilane, 3-triethoxysilyl-N-(1,3-dimethyl-butylidene)propylamine, N-phenyl-3-aminopropyltrimethoxysilane, N-(vinylbenzyl)-2-aminoethyl-3-aminopropyltrimethoxysilane hydrochloride, 3-ureidepropyltriethoxysilane, 3-chloropropyltrimethoxysilane, 3-mercaptopropylmethyldimethoxysilane, 3-mercaptopropyltrimethoxysilane, bis (triethoxysilylpropyl)tetrasulfide, and 3-isocyanate propyltriethoxysilane, which are silane coupling agents having an amino group. In addition, examples of commercially available products which can be used include "KBM-403", "KBM-602", "KBM-603", "KBE-603", "KBM-903", "KBE-903", "KBE-9103", "KBM-573", "KBP-90" (all trade names, manufactured by Shin-Etsu Chemical Co.), "XS1003" (trade name, manufactured by Chisso Corporation), and the like.

The hydrolytic condensation of the aforementioned aminosilane can be carried out by a method well known to persons skilled in the art. Specifically, the hydrolytic condensation can be carried out by adding water required for hydrolysis of the alkoxysilyl group to at least one kind of aminosilane compound, and stirring the mixture while heating as needed. The degree of condensation can be regulated with the amount of water used.

A higher degree of condensation of aminosilane hydrolysis condensate is preferred, since in this case where zirconium is deposited as an oxide, the above aminosilane hydrolysis condensate tends to be easily incorporated therein. For example, the proportion on a mass basis of dimer or higher-order multimers of aminosilane in the total amount of the aminosilane is preferably no less than 40%, more preferably no less than 50%, still more preferably no less than 70%, and even more preferably no less than 80%. Therefore, when aminosilane is allowed to react in a hydrolytic condensation reaction, it is preferred to permit the reaction under conditions in which aminosilane is more likely to be hydrolysed and condensed such as those in which an aqueous solvent containing a catalyst such as acetic acid and alcohol is used as the solvent. In addition, by allowing for a reaction under conditions with a comparatively high aminosilane concentration, a hydrolysis condensate having a high degree of condensation is obtained. Specifically, it is preferred to allow for the hydrolytic condensation at an aminosilane concentration falling within the range of 5% by mass to 50% by mass. The degree of condensation can be determined by measurement with $^{29}$Si-NMR.

As the polyvinylamine and polyallylamine, commercially available products can be used. Examples of polyvinylamine include "PVAM-0595B" (trade name, manufactured by Mitsubishi Chemical Corporation) and the like, and examples of the polyallylamine include "PAA-01", "PAA-10C", "PAA-H-10C", "PAA-D-41HCl" (all trade names, manufactured by Nitto Boseki Co., Ltd.) and the like.

The molecular weight of the polyamine compound is preferably in the range of 150 to 500,000. When the molecular weight is less than 150, a conversion coating film having sufficient adhesiveness may not be obtained. When the molecular weight exceeds 500,000, formation of the coating film may be inhibited. The lower limit and the upper limit are more preferably 5,000 and 70,000, respectively. The commercially available polyamine compound may adversely influence the coating film due to too large an amount of the amino group.

The content of the polyamine compound in the metal surface treatment liquid for cation electrodeposition coating of the present invention can be in the range of 1 to 200% based on mass of the zirconium metal included in the surface treatment liquid. When the content is less than 1%, the intended effect cannot be exhibited, while content exceeding 200% may lead to failure in sufficient formation of the coating film. The upper limit of the content is more preferably 120%, still more preferably 100%, even more preferably 80%, and particularly preferably 60%.

In the present invention, sulfonic acid can be used in place of the polyamine compound, or in combination with the polyamine compound. By using sulfonic acid, a similar effect to that of the polyamine compound can be exhibited. As a sulfonic acid, for example, a sulfonic acid having a benzene ring such as naphthalene sulfonic acid, methanesulfonic acid and the like can be used. Therefore, exemplary preferable metal surface treatment liquids for cation electrodeposition coating of the present invention include, for example, the metal surface treatment liquids for cation electrodeposition coating which contain zirconium ions, copper ions, other metal ions, and sulfonic acid; and the metal surface treatment liquids for cation electrodeposition coating which contain zirconium ions, copper ions, other metal ions, a polyamine compound, and sulfonic acid. The metal ions used in these metal surface treatment liquids for cation electrodeposition coating are preferably aluminum ions and/or tin ions. Furthermore, a fluorine ion described later may also be included.

It is preferred that the metal surface treatment liquid for cation electrodeposition coating of the present invention contains a fluorine ion. Since the concentration of the fluorine ion varies depending on the pH, the amount of free fluorine ion is defined at a specified pH. In the present invention, the amount of the free fluorine ion at a pH of 3.0 is in the range of 0.1 to 50 ppm. When the amount is less than 0.1 ppm, the metal base material cannot be sufficiently etched so that the coating film amount is decreased, and sufficient anti-corrosion properties cannot be achieved. In addition, the treatment liquid may not have enough stability. In contrast, when the amount is above 50 ppm, excessive etching may lead to failure in formation of sufficient coating film, or an un-uniform adhesion amount and film thickness of the coating film may adversely affect the coating appearance and the like. The lower limit and the upper limit are preferably 0.5 ppm and 10 ppm, respectively. Therefore, exemplary preferable metal surface treatment liquids for cation electrodeposition coating of the present invention include the metal surface treatment liquids for cation electrodeposition coating which contain zirconium ions, copper ions, other metal ions, and fluorine. The metal ions used in this case are preferably aluminum ions and/or tin ions.

The metal surface treatment liquid for cation electrodeposition coating of the present invention may include a chelate compound. By including the chelate compound, deposition of metals other than zirconium can be suppressed, and the coating film of zirconium oxide can be stably formed. As the chelate compound, amino acid, aminocarboxylic acid, a phenolic compound, aromatic carboxylic acid and the like can be exemplified. Carboxylic acid having a hydroxyl group such as citric acid and gluconic acid, conventionally known as chelating agents, cannot exert their function enough in the present invention.

As the amino acid, a variety of naturally occurring amino acids and synthetic amino acids, as well as synthesized amino acids having at least one amino group and at least one acid group (carboxyl group, sulfonic acid group or the like) in one molecule, can be extensively utilized. Among these, at least one selected from the group consisting of alanine, glycine, glutamic acid, aspartic acid, histidine, phenylalanine, asparagine, arginine, glutamine, cysteine, leucine, lysine, proline, serine, tryptophan, valine and tyrosine, and a salt thereof can be preferably used. Furthermore, when there is an optical isomer of the amino acid, any one can be suitably used irrespective of the forms, i.e. L-form, D-form, or racemic bodies.

In addition, as the aminocarboxylic acid, a compound having both functional groups, an amino group and a carboxyl group in one molecule other than the amino acid described above, can be extensively used. Among these, at least one selected from the group consisting of diethylenetriamine pentaacetic acid (DTPA), hydroxyethylethylenediamine triacetic acid (HEDTA), triethylenetetraamine hexaacetic acid (TTHA), 1,3-propanediamine tetraacetic acid (PDTA), 1,3-diamino-6-hydroxypropane tetraacetic acid (DPTA-OH), hydroxyethylimino diacetic acid (HIDA), dihydroxyethylglycine (DHEG), glycolether diamine tetraacetic acid (GEDTA), dicarboxymethyl glutamic acid (CMGA), (S,S)-ethylenediamine disuccinic acid (EDDS), and a salt thereof can be preferably used. Moreover, ethylenediamine tetraacetic acid (EDTA) and nitrilotriacetic acid can be also used; however, in light of toxicity and low biodegradability, extreme care is necessary in use. Nitrilotriacetic acid sodium salt that is a sodium salt of NTA can be suitably used because the aforementioned problems are believed to be less likely to be associated.

Furthermore, examples of the phenolic compound include compounds having two or more phenolic hydroxyl groups, and phenolic compounds including the same as a basic skeleton. Examples of the former include catechol, gallic acid, pyrogallol, tannic acid, and the like. Meanwhile, examples of the latter include flavonoids such as flavone, isoflavone, flavonol, flavanone, flavanol, anthocyanidin, aurone, chalcone, epigallocatechin gallate, gallocatechin, theaflavin, daidzin, genistin, rutin, and myricitrin, polyphenolic compounds including tannin, catechin and the like, polyvinylphenol, water soluble resol, novolak resins, lignin, and the like. Among them, tannin, gallic acid, catechin and pyrogallol are particularly preferred.

When the chelating agent is included, the content is preferably 0.5 to 10 times the concentration of the total concentration of the copper ions and other metal ions except for zirconium. When the concentration is less than 0.5 times, the intended effect cannot be exhibited, while a concentration exceeding 10 times may adversely influence formation of the coating film.

The metal surface treatment liquid for cation electrodeposition coating of the present invention may contain various cations in addition to the aforementioned components. Examples of the cation include magnesium, zinc, calcium, gallium, iron, manganese, nickel, cobalt, silver, and the like. In addition, there exist cations and anions that are derived from a base or an acid added for adjusting the pH, or are included as the counter ions of the aforementioned components.

The metal surface treatment liquid for cation electrodeposition coating of the present invention can be produced by placing each of the components thereof, and/or compound containing the same into water, followed by mixing.

Examples of the compound for supplying the zirconium ions include fluorozirconic acid, salts of fluorozirconic acid such as potassium fluorozirconate and ammonium fluorozirconate, zirconium fluoride, zirconium oxide, zirconium oxide colloid, zirconyl nitrate, zirconium carbonate, and the like. Moreover, as the compound that supplies the copper ions, copper acetate, copper nitrate, copper sulfate, copper chloride, and the like can be exemplified.

On the other hand, as the compound that supplies the other metal ions, nitrate, sulfate, acetate, chloride and fluoride of the same can be exemplified.

Furthermore, as the compound that supplies the fluorine ions, for example, fluorides such as hydrofluoric acid, ammonium fluoride, fluoboric acid, ammonium hydrogen fluoride, sodium fluoride, sodium hydrogen fluoride, and the like can be exemplified. Additionally, a complex fluoride can also be used as the source, and examples thereof include hexafluorosilicic acid salts, specifically, hydrofluosilicic acid, zinc hydrofluosilicicate, manganese hydrofluosilicate, magnesium hydrofluosilicate, nickel hydrofluosilicate, iron hydrofluosilicate, calcium hydrofluosilicate, and the like. Furthermore, a compound that supplies zirconium ions and is a complex fluoride is also acceptable. Moreover, copper acetate, copper nitrate, copper sulfate, copper chloride and the like as the compound that supplies copper ions; aluminum nitrate, aluminum fluoride and the like as the compound that supplies aluminum ions; and indium nitrate, indium chloride and the like as the compound that supplies an indium ions can be exemplified, respectively.

After mixing these components, the metal surface treatment liquid for cation electrodeposition coating of the present invention can be regulated to have a predetermined value of pH using an acidic compound such as nitric acid or sulfuric acid, and a basic compound such as sodium hydroxide, potassium hydroxide or ammonia. The method of the metal surface treatment of the present invention includes a step of subjecting a metal base material to a surface treatment using the metal surface treatment liquid described above.

The metal base material is not particularly limited as long as it can be cation electrodeposited, and for example, iron-based metal base material, aluminum-based metal base material, zinc-based metal base material and the like can be exemplified.

Examples of the iron-based metal base material include cold-rolled steel plates, hot-rolled steel plates, soft steel plates, high-tensile steel plates, and the like. Moreover, examples of the aluminum-based metal base material include 5,000 series aluminum alloys, 6,000 series aluminum alloys, and aluminum-coated steel plates treated by aluminum-based electroplating, hot dipping, or vapor deposition plating. Furthermore, examples of the zinc-based metal base material include zinc or zinc-based alloy coated steel plates treated by zinc-based electroplating, hot dipping, or vapor deposition plating such as zinc coated steel plate, zinc-nickel coated steel plate, zinc-titanium coated steel plate, zinc-magnesium coated steel plate, zinc-manganese coated steel plate, and the like. There are a variety of grades of the high-tensile steel plate depending on the strength and manufacture method, and examples thereof include JSC400J, JSC440P, JSC440W, JSC590R, JSC590T, JSC590Y, JSC780T, JSC780Y, JSC980Y, JSC1180Y, and the like.

Metal base materials including a combination of multiple kinds of metals such as iron-based, aluminum-based, zinc-based metals and the like (including joint area and contact area of different kinds of metals) can be simultaneously applied as the metal base material.

The surface treatment step may be carried out by bringing the metal surface treatment liquid into contact with the metal base material. Specific examples of the method include a dipping method, a spraying method, a roll coating method, a pouring method, and the like.

The treatment temperature in the surface treatment step preferably falls within the range of 20 to 70° C. When the temperature is lower than 20° C., it is possible to cause failure in formation of a sufficient coating film, while a corresponding effect cannot be expected at a temperature above 70° C. The lower limit and the upper limit are more preferably 30° C. and 50° C., respectively.

The treatment time period in the surface treatment step is preferably 2 to 1100 seconds. When the time period is less than 2 seconds, a sufficient coating film amount may not be attained, while a corresponding effect cannot be expected even though it is longer than 1100 sec. The lower limit and the upper limit are still more preferably 30 seconds and 120 seconds, respectively. Accordingly, a coating film is formed on the metal base material.

The surface treated metal base material of the present invention is obtained by the surface treatment method described above. On the surface of the metal base material is formed a coating film that contains zirconium, copper and the other metal. Although the element ratio of copper and the other metal in the coating film is not particularly limited, the ratio is preferably in the range of 1/100 to 10/1 when the other metal is tin or indium. When the ratio is out of this range, the intended performance may not be attained.

The content of zirconium in the coating film is preferably no less than 10 mg/m$^2$ in the case of iron-based metal base materials. When the content is less than 10 mg/m$^2$, sufficient anti-corrosion properties may not be achieved. The content is more preferably no less than 20 mg/m$^2$, and still more preferably no less than 30 mg/m$^2$. Although the upper limit is not specifically defined, too large an amount of the coating film may lead to an increased likelihood of crack generation of the rust-preventive coating film, and may make it difficult to obtain a uniform coating film. In this respect, the content of zirconium in the coating film is preferably no greater than 1 g/m$^2$, and more preferably no greater than 800 mg/m$^2$.

The content of copper in the coating film is preferably no less than 0.5 mg/m$^2$ in order to achieve the intended effect.

The method of cation electrodeposition coating of the present invention includes a step of subjecting a metal base material to a surface treatment using the metal surface treatment liquid described above, and a step of subjecting the surface treated metal base material to cation electrodeposition coating.

The surface treatment step in the aforementioned cation electrodeposition coating is same as the surface treatment step in the surface treatment method described above. The surface treated metal base material obtained in the surface treatment step may be subjected to the cation electrodeposition coating step directly or after washing.

In the cation electrodeposition coating step, the surface treated metal base material is subjected to the cation electrodeposition coating. In the cation electrodeposition coating, the surface treated metal base material is dipped in cation electrodeposition coating solution, and a voltage of 50 to 450 V is applied thereto using the same as a cathode for a certain period of time. Although the application time period of voltage may vary depending on the conditions of the electrodeposition, it is generally 2 to 4 minutes.

As the cation electrodeposition coating solution, a generally well known one can be used. Specifically, such general coating solutions are prepared by blending: a binder cationized through adding amine or sulfide to an epoxy group carried by an epoxy resin or an acrylic resin, followed by adding thereto a neutralizing acid such as acetic acid; block isocyanate as a curing agent; and a pigment dispersing paste including a rust-preventive pigment dispersed in a resin.

After completing the cation electrodeposition coating step, a hardened coated film can be obtained by baking at a predetermined temperature directly or after washing with water. Although the baking conditions may vary depending on the type of the cation electrodeposition coating solution used, usually the baking may be conducted in the range of 120 to 260° C., and preferably in the range of 140 to 2.20° C. The baking time period can be 10 to 30 minutes. The resulting metal base material coated by the cation electrodeposition is also involved as an aspect of the present invention.

EXAMPLES

Production Example 1

Production of Hydrolysis Condensate of Aminosilane, Part 1

As aminosilane, 5 parts by mass of KBE603 (3-aminopropyl-triethoxysilane, effective concentration: 100%, manufactured by Shin-Etsu Chemical Co., Ltd.) was added dropwise using a dropping funnel to a mixed solvent (solvent temperature: 25° C.) containing 47.5 parts by mass of deionized water and 47.5 parts by mass of isopropyl alcohol over 60 minutes to a homogenous state, followed by allowing for reaction under a nitrogen atmosphere at 25° C. for 24 hours. Then, the reaction solution was subjected to a reduced pressure to allow for evaporation of isopropyl alcohol, and deionized water was further added thereto, whereby a hydrolysis condensate of aminosilane including 5% of the active ingredient was obtained.

Production Example 2

Production of Hydrolysis Condensate of Aminosilane, Part 2

In a similar manner to Production Example 1, except that the amounts were changed to 20 parts by mass of KBE603, 40 parts by mass of deionized water, and 40 parts by mass of isopropyl alcohol, a hydrolysis condensate of aminosilane including 20% of the active ingredient was obtained.

Example 1

A metal surface treatment liquid for cation electrodeposition coating was obtained by: mixing a 40% aqueous zircon acid solution as a zirconium ion source, copper nitrate as a copper ion source, tin sulfate as the other metal ion source, and hydrofluoric acid; diluting the mixture to give the zirconium ion concentration of 500 ppm, the copper ion concentration of 10 ppm, and the tin ion concentration of 20 ppm; and adjusting the pH to 3.5 using nitric acid and sodium hydroxide. Measurement of free fluorine ion concentration using a fluorine ion meter after adjusting the pH of this treatment liquid to 3.0 revealed a value of 5 ppm.

Example 2

A metal surface treatment liquid for cation electrodeposition coating was obtained in a similar manner to Example 1, except that: the hydrolysis condensate of aminosilane obtained in Production Example 1 was further added to be 200 ppm; aluminum nitrate was used in place of tin sulfate so as to give an aluminum ion concentration of 50 ppm; and the pH was adjusted to 2.75. Measurement of the free fluorine ion concentration using a fluorine ion meter after adjusting the pH of this treatment liquid to 3.0 revealed a value of 5 ppm.

Example 3

A metal surface treatment liquid for cation electrodeposition coating was obtained in a similar manner to Example 1, except that: polyallylamine "PAA-H-10C" (trade name, manufactured by Nitto Boseki Co., Ltd.) was further added to be 25 ppm; zirconium ion concentration was changed to 250 ppm; and the pH was adjusted to 3.0. Measurement of the free fluorine ion concentration using a fluorine ion meter on this treatment liquid revealed a value of 5 ppm.

Example 4

A metal surface treatment liquid for cation electrodeposition coating was obtained in a similar manner to Example 2, except that: indium nitrate was used in place of aluminum nitrate so as to give an indium ion concentration of 50 ppm; and the pH was adjusted to 3.0. Measurement of the free fluorine ion concentration using a fluorine ion meter on this treatment liquid revealed a value of 5 ppm.

Example 5

A metal surface treatment liquid for cation electrodeposition coating was obtained in a similar manner to Example 4, except that: diethylenetriamine pentaacetic acid (DTPA) was added as a chelating agent to give a concentration of 100 ppm; the hydrolysis condensate of aminosilane was changed to that obtained in Production Example 2 and was added to give the concentration of 200 ppm; the copper ion concentration was changed to 20 ppm; and tin sulfate was used in place of indium nitrate so as to give a tin ion concentration of 20 ppm. Measurement of the free fluorine ion concentration using a fluorine ion meter on this treatment liquid revealed a value of 5 ppm.

Example 6

A metal surface treatment liquid for cation electrodeposition coating was obtained in a similar manner to Example 2, except that yttrium nitrate was used in place of aluminum nitrate so as to give an yttrium ion concentration of 50 ppm. Measurement of the free fluorine ion concentration using a fluorine ion meter after adjusting the pH of this treatment liquid to 3.0 revealed a value of 5 ppm.

Example 7

A metal surface treatment liquid for cation electrodeposition coating was obtained in a similar manner to Example 1, except that: the hydrolysis condensate of aminosilane obtained in Production Example 1 was further added to be 200 ppm; and the zirconium ion concentration, the copper ion concentration, and the tin ion concentration were changed to 2,000 ppm, 100 ppm, and 200 ppm, respectively. Measurement of the free fluorine ion concentration using a fluorine ion meter after adjusting the pH of this treatment liquid to 3.0 revealed a value of 5 ppm.

Example 8

A metal surface treatment liquid for cation electrodeposition coating was obtained in a similar manner to Example 2, except that niobium nitrate was used in place of aluminum nitrate so as to give a niobium ion concentration of 50 ppm. Measurement of the free fluorine ion concentration using a fluorine ion meter after adjusting the pH of this treatment liquid to 3.0 revealed a value of 10 ppm.

Example 9

A metal surface treatment liquid for cation electrodeposition coating was obtained in a similar manner to Example 2, except that: sodium nitrate was further added so as to give a sodium ion concentration of 5,000 ppm; and tin sulfate was used in place of aluminum nitrate so as to give a tin ion concentration of 30 ppm. Measurement of the free fluorine ion concentration using a fluorine ion meter after adjusting the pH of this treatment liquid to 3.0 revealed a value of 5 ppm.

Examples 10 to 22

Metal surface treatment liquids for cation electrodeposition coating were obtained, respectively, in a similar manner to Example 1, except that: the polyamine compound described in Table 1 was added in a specified amount; and the type and concentration of each component were changed as shown in Table 1. The free fluorine ion concentrations measured using a fluorine ion meter on these treatment liquids under a condition of pH 3.0 are shown together in Table 1.

Examples 23 to 29

Metal surface treatment liquids for cation electrodeposition coating were obtained, respectively, in a similar manner to Example 1, except that: the polyamine compound described in Table 1 was added in a specified amount; and the type and concentration of each component were changed as shown in Table 1. The free fluorine ion concentrations measured using a fluorine ion meter on these treatment liquids under a condition of pH 3.0 are shown together in Table 1.

Examples 30 to 57

Metal surface treatment liquids for cation electrodeposition coating were obtained, respectively, in a similar manner to each of Examples 2 to 29, except that the polyamine compound was not added. The free fluorine ion concentrations measured using a fluorine ion meter oh these treatment liquids under a condition of pH 3.0 are shown together in Table 2.

Example 58

A metal surface treatment liquid for cation electrodeposition coating was obtained in a similar manner to Example 29, except that: the polyamine compound was changed to methanesulfonic acid; and the concentrations were changed as shown in Table 1. The free fluorine ion concentration measured using a fluorine ion meter on this treatment liquid under a condition of pH 3.0 is shown together in Table 2.

Comparative Examples 1 to 5

Preparation of Comparative Metal Surface Treatment Liquid

According to the description in Table 3, comparative metal surface treatment liquids were obtained, respectively, based on the aforementioned Examples.

Thus resulting metal surface treatment liquids are summarized in Table 3.

TABLE 1

| | Zr concentration (ppm) | Cu concentration (ppm) | Cu/Zr ratio | Zr + Cu (ppm) | Other metal ions (ppm) | | | Other metal ions/ Cu ratio | pH | Polyamine | Free fluorine |
|---|---|---|---|---|---|---|---|---|---|---|---|
| Example 1 | 500 | 10 | 0.02 | 510 | tin sulfate | Sn | 10 | 1 | 3.5 | absent | 5 |
| Example 2 | 500 | 10 | 0.02 | 510 | aluminum nitrate | Al | 10 | 1 | 2.75 | APS (Production Example 1, 200) | 5 |
| Example 3 | 250 | 10 | 0.04 | 260 | tin sulfate | Sn | 10 | 1 | 3 | PAA (25) | 5 |
| Example 4 | 500 | 10 | 0.02 | 510 | indium nitrate | In | 10 | 1 | 3 | APS (Production Example 1, 200) | 5 |
| Example 5 | 500 | 20 | 0.04 | 520 | tin sulfate | Sn | 20 | 1 | 3 | APS (Production Example 2, 200) | 5 |
| Example 6 | 500 | 10 | 0.02 | 510 | yttrium nitrate | Y | 10 | 1 | 2.75 | APS (Production Example 1,200), DTPA (100) | 5 |
| Example 7 | 2000 | 100 | 0.05 | 2100 | tin sulfate | Sn | 100 | 1 | 3.5 | APS (Production Example 1, 200) | 5 |
| Example 8 | 500 | 10 | 0.02 | 510 | niobium nitrate | Nb | 10 | 1 | 2.75 | APS (Production Example 1, 200) | 10 |
| Example 9 | 500 | 10 | 0.02 | 510 | tin sulfate | Sn | 10 | 1 | 2.75 | APS (Production Example 1, 200), sodium nitrate (5000) | 5 |
| Example 10 | 500 | 10 | 0.02 | 510 | tin sulfate | Sn | 10 | 1 | 3 | APS (Production Example 1, 200) | 1 |
| Example 11 | 500 | 10 | 0.02 | 510 | tin sulfate | Sn | 10 | 1 | 3 | APS (Production Example 1, 200) | 20 |
| Example 12 | 20 | 2 | 0.1 | 22 | tin sulfate | Sn | 2 | 1 | 2 | APS (Production Example 1, 20) | 2 |
| Example 13 | 5000 | 50 | 0.01 | 5050 | tin sulfate | Sn | 50 | 1 | 5.5 | APS (Production Example 1, 2000) | 10 |
| Example 14 | 5000 | 25 | 0.005 | 5025 | tin sulfate | Sn | 25 | 1 | 3 | APS (Production Example 1, 2000) | 10 |
| Example 15 | 25 | 25 | 1 | 50 | tin sulfate | Sn | 25 | 1 | 3 | APS ( Production Example 2, 20) | 2 |
| Example 16 | 100 | 5 | 0.05 | 105 | tin sulfate | Sn | 5 | 1 | 3 | APS ( Production Example 2, 50) | 3 |
| Example 17 | 100 | 5 | 0.05 | 105 | tin sulfate | Sn | 5 | 1 | 3 | APS (Production Example 1, 50) | 3 |
| Example 18 | 500 | 10 | 0.02 | 510 | indium nitrate | In | 10 | 1 | 2.75 | APS (Production Example 1, 200) | 5 |
| Example 19 | 500 | 10 | 0.02 | 510 | aluminum nitrate | Al | 10 | 1 | 2.75 | APS (Production Example 1, 200) | 5 |
| Example 20 | 500 | 10 | 0.02 | 510 | tin sulfate | Sn | 10 | 1 | 4 | APS (Production Example 2, 50) | 0 |
| Example 21 | 500 | 10 | 0.02 | 510 | tin sulfate | Sn | 10 | 1 | 4.5 | APS (Production Example 2, 50) | 0.1 |

TABLE 1-continued

| | Zr concentration (ppm) | Cu concentration (ppm) | Cu/Zr ratio | Zr + Cu (ppm) | Other metal ions (ppm) | | | Other metal ions/ Cu ratio | pH | Polyamine | Free fluorine |
|---|---|---|---|---|---|---|---|---|---|---|---|
| Example 22 | 500 | 10 | 0.02 | 510 | tin sulfate | Sn | 10 | 1 | 4 | APS (Production Example 2, 50) | 50 |
| Example 23 | 500 | 10 | 0.02 | 510 | aluminum nitrate tin sulfate | Al (500), Sn (20) | 520 | 52 | 3.5 | APS (Production Example 1, 200) | 5 |
| Example 24 | 500 | 10 | 0.02 | 510 | aluminum nitrate tin sulfate | Al (200), Sn (20) | 220 | 22 | 4 | PAA (25) | 5 |
| Example 25 | 100 | 10 | 0.1 | 110 | aluminum nitrate tin sulfate | Al (200), Sn (20) | 220 | 22 | 4 | APS (Production Example 1,200) | 5 |
| Example 26 | 100 | 10 | 0.1 | 110 | aluminum nitrate tin sulfate | Al (200), Sn (20) | 220 | 22 | 4 | PAA (25) | 5 |
| Example 27 | 500 | 10 | 0.02 | 510 | tin sulfate | Sn (20) | 20 | 2 | 3.5 | PAA (50) | 5 |
| Example 28 | 100 | 1 | 0.01 | 101 | aluminum nitrate tin sulfate | Al (500), Sn (50) | 550 | 550 | 3.5 | PAA (50) | 5 |
| Example 29 | 200 | 50 | 0.25 | 250 | aluminum nitrate tin sulfate | Al (200), Sn (50) | 250 | 5 | 3.5 | PAA (50) | 5 |

TABLE 2

| | Zr concentration (ppm) | Cu concentration (ppm) | Cu/Zr ratio | Zr + Cu (ppm) | Other metal ions (ppm) | | | Other metal ions/ Cu ratio | pH | Polyamine | Free fluorine |
|---|---|---|---|---|---|---|---|---|---|---|---|
| Example 30 | 500 | 10 | 0.02 | 510 | aluminum nitrate | Al | 10 | 1 | 2.75 | Absent | 5 |
| Example 31 | 250 | 10 | 0.04 | 260 | tin sulfate | Sn | 10 | 1 | 3 | Absent | 5 |
| Example 32 | 500 | 10 | 0.02 | 510 | indium nitrate | In | 10 | 1 | 3 | Absent | 5 |
| Example 33 | 500 | 20 | 0.04 | 520 | tin sulfate | Sn | 20 | 1 | 3 | Absent | 5 |
| Example 34 | 500 | 10 | 0.02 | 510 | yttrium nitrate | Y | 10 | 1 | 2.75 | Absent | 5 |
| Example 35 | 2000 | 100 | 0.05 | 2100 | tin sulfate | Sn | 100 | 1 | 3.5 | Absent | 5 |
| Example 36 | 500 | 10 | 0.02 | 510 | niobium nitrate | Nb | 10 | 1 | 2.75 | Absent | 10 |
| Example 37 | 500 | 10 | 0.02 | 510 | tin sulfate | Sn | 10 | 1 | 2.75 | Absent | 5 |
| Example 38 | 500 | 10 | 0.02 | 510 | tin sulfate | Sn | 10 | 1 | 3 | Absent | 1 |
| Example 39 | 500 | 10 | 0.02 | 510 | tin sulfate | Sn | 10 | 1 | 3 | Absent | 20 |
| Example 40 | 20 | 2 | 0.1 | 22 | tin sulfate | Sn | 2 | 1 | 2 | Absent | 2 |
| Example 41 | 5000 | 50 | 0.01 | 5050 | tin sulfate | Sn | 50 | 1 | 5.5 | Absent | 10 |
| Example 42 | 5000 | 25 | 0.005 | 5025 | tin sulfate | Sn | 25 | 1 | 3 | Absent | 10 |
| Example 43 | 25 | 25 | 1 | 50 | tin sulfate | Sn | 25 | 1 | 3 | Absent | 2 |
| Example 44 | 100 | 5 | 0.05 | 105 | tin sulfate | Sn | 5 | 1 | 3 | Absent | 3 |
| Example 45 | 100 | 5 | 0.05 | 105 | tin sulfate | Sn | 5 | 1 | 3 | Absent | 3 |
| Example 46 | 500 | 10 | 0.02 | 510 | indium nitrate | In | 10 | 1 | 2.75 | Absent | 5 |
| Example 47 | 500 | 10 | 0.02 | 510 | aluminum nitrate | Al | 10 | 1 | 2.75 | Absent | 5 |
| Example 48 | 500 | 10 | 0.02 | 510 | tin sulfate | Sn | 10 | 1 | 4 | Absent | 0 |

TABLE 2-continued

| | Zr concentration (ppm) | Cu concentration (ppm) | Cu/Zr ratio | Zr + Cu (ppm) | Other metal ions (ppm) | | | Other metal ions/ Cu ratio | pH | Polyamine | Free fluorine |
|---|---|---|---|---|---|---|---|---|---|---|---|
| Example 49 | 500 | 10 | 0.02 | 510 | tin sulfate | Sn | 10 | 1 | 4.5 | Absent | 0.1 |
| Example 50 | 500 | 10 | 0.02 | 510 | tin sulfate | Sn | 10 | 1 | 4 | Absent | 50 |
| Example 51 | 500 | 10 | 0.02 | 510 | aluminum nitrate tin sulfate | Al (500), Sn (20) | 520 | 52 | 3.5 | Absent | 5 |
| Example 52 | 500 | 10 | 0.02 | 510 | aluminum nitrate tin sulfate | Al (200), Sn (20) | 220 | 22 | 4 | Absent | 5 |
| Example 53 | 100 | 10 | 0.1 | 110 | aluminum nitrate tin sulfate | Al (200), Sn (20) | 220 | 22 | 4 | Absent | 5 |
| Example 54 | 100 | 10 | 0.1 | 110 | aluminum nitrate tin sulfate | Al (200), Sn (20) | 220 | 22 | 4 | Absent | 5 |
| Example 55 | 500 | 10 | 0.02 | 510 | tin sulfate | Sn (20) | 20 | 2 | 3.5 | Absent | 5 |
| Example 56 | 100 | 1 | 0.01 | 101 | aluminum nitrate tin sulfate | Al (500), Sn (50) | 550 | 550 | 3.5 | Absent | 5 |
| Example 57 | 200 | 50 | 0.25 | 250 | aluminum nitrate tin sulfate | Al (200), Sn (50) | 250 | 5 | 3.5 | Absent | 5 |
| Example 58 | 200 | 50 | 0.25 | 250 | aluminum nitrate tin sulfate | Al (200), Sn (50) | 250 | 5 | 3.5 | Methanesul-fonic acid (50) | 5 |

TABLE 3

| | Zr concentration (ppm) | Cu concentration (ppm) | Cu/Zr ratio | Zr + Cu (ppm) | Other metal ions (ppm) | | | Other metal ions/ Cu ratio | pH | Polyamine | Free fluorine |
|---|---|---|---|---|---|---|---|---|---|---|---|
| Comparative Example 1 | 500 | 0 | 0 | 500 | absent | — | 0 | — | 3.5 | APS (Production Example 1, 200) | 7 |
| Comparative Example 2 | 500 | 0 | 0 | 500 | yttrium nitrate | Y | 50 | — | 3 | APS (Production Example 1, 200) | 5 |
| Comparative Example 3 | 2000 | 100 | 0.05 | 2100 | absent | — | 0 | 0 | 3.5 | APS (Production Example 1, 200) | 5 |
| Comparative Example 4 | 500 | 10 | 0.02 | 510 | tin sulfate | Sn | 20 | 2 | 1 | APS (Production Example 1, 200) | 5 |
| Comparative Example 5 | 500 | 10 | 0.02 | 510 | tin sulfate | Sn | 20 | 2 | 8 | APS (Production Example 1, 200) | 5 |

Surface Treatment

A commercially available cold-rolled steel plate (SPC, manufactured by Nippon Testpanel Co., Ltd., 70 mm×150 mm×0.8 mm) was provided as a metal base material, which was subjected to a degreasing treatment using "SURF-CLEANER EC92" (trade name, manufactured by Nippon Paint Co., Ltd.) as an alkali degreasing treatment agent at 40° C. for 2 minutes. This plate was dipped and washed in a water washing bath, and then washed by spraying tap water thereon for approximately 30 seconds.

The metal base material following the degreasing treatment was subjected to a surface treatment by dipping thereof in the metal surface treatment liquid prepared in Examples and Comparative Examples at 40° C. for 90 seconds. The treatment time period was 120 seconds in Examples 2 to 4 and 30 to 32; 15 seconds in Examples 10 and 38; and 240 seconds in Examples 12 and 40. After completing the surface treatment, the plate was dried at 40° C. for 5 minutes, and the thus surface treated metal base material was obtained. Unless specifically stated, this surface treated metal base material was used as a test plate in the following evaluation.

Measurement of Element Content in Coating Film

The content of each element included in the coating film was measured using an X-ray fluorescence spectrometer "XRF1700" manufactured by Shimadzu Corporation.

Observation of Sludge

With 10 L of the surface treatment liquids of the Examples and Comparative Examples, 200 test panels were subjected to the surface treatment, and evaluation was made according to the following standards through visual observation as to whether the surface treatment liquid became turbid due to generation of sludge following the lapse of 30 days at room temperature.

A: transparent liquid
B: slightly turbid
C: turbid
D: precipitate (sludge) generated Evaluation of Throwing Power The throwing power was evaluated according to a "four-plate box method" described in Japanese Unexamined Patent Application, First Publication No. 2000-038525. More specifically, as shown in FIG. 1, four test plates were disposed to stand up in parallel with intervals of 20 mm to produce a box 10 sealed with an insulator such as cloth adhesive tape at the underneath of both side faces and the bottom face. Through-holes 5 having a diameter of 8 mm were provided underneath of test plates 1, 2 and 3 except for test plate 4.

This box 10 was dipped into an electrodeposition coating vessel 20 filled with a cation electrodeposition coating solution "POWERNICS 110" (trade name, manufactured by Nippon Paint Co., Ltd.). In this case, the cation electrodeposition coating solution entered inside the box 10 only from each through-hole 5.

Each of the test plates 1 to 4 was electrically connected while stirring the cation electrodeposition coating solution with a magnetic stirrer, and a counter electrode 21 was arranged such that the distance from the test plate 1 became 150 mm. Voltage was applied with each of the test plates 1 to 4 as cathodes, and the counter electrode 21 as an anode to execute cation electrodeposition coating. The coating was carried out by elevating to the intended voltage (210 V and 160 V) over 30 seconds from initiation of the application, and thereafter maintaining the voltage for 150 seconds. The bath temperature in this process was regulated to 30° C.

After washing each of the test plates 1 to 4 with water after coating, they were baked at 170° C. for 25 minutes, followed by air cooling. The throwing power was then evaluated by measuring the film thickness of the coated film formed on side A of the test plate 1 that is the closest to the counter electrode 21, and the film thickness of the coated film formed on side G of the test plate 4 that is the farthest from the counter electrode 21 to determine a ratio of the film thickness (side G)/film thickness (side A). As this value becomes greater, better evaluation of the throwing power can be decided. The acceptable level was no less than 40%.

Painting Voltage

Using the surface treatment liquids of Examples and Comparative Examples, cold-rolled steel plates and zinc coated steel plates were subjected to a surface treatment, whereby test plates were obtained. Using the cation electrodeposition coating solution "POWERNICS 110" described above on these test plates, the voltage required for obtaining a 20 μm electrodeposition coated film was determined. The difference in coating voltage required for obtaining the 20 μm electrodeposition coated film was then determined between the case in which the metal base material was a zinc coated steel plate, and the case of the cold-rolled steel plate. As the difference becomes smaller, superiority as a surface treated coating film is suggested. A difference of no greater than 40 V is acceptable.

The voltage required for obtaining a 20 μm electrodeposition coated film was determined as in the following manner. Under the electrodeposition condition, the voltage was elevated to a specified voltage over 30 seconds, and thereafter maintained for 150 seconds. The resulting film thickness was measured. Such a procedure was conducted for 150 V, 200 V, and 250 V. Thus, a voltage to give a 20 μm film thickness was derived from the formula of relationship between the determined voltage and the film thickness.

Appearance of Coating

The test plate was subjected to cation electrodeposition coating, and the appearance of the resulting electrodeposition coated film was evaluated according to the following standards.

A: uniform coated film obtained
B: nearly uniform coated film obtained
C: some non-uniformity of the coated film found
D: non-uniformity of the coated film found Secondary Adhesion Test (SDT)

After forming a 20 μm electrodeposition coated film, the test plates were incised to provide two parallel cut lines that ran longitudinally, with the depth to reach to the metal basis material, and then immersed in a 5% aqueous sodium chloride solution at 55° C. for 240 hours. After water washing and air drying, an adhesive tape "L-PACK LP-24" (trade name, manufactured by Nichiban Co., Ltd.) was adhered to the portion including the cuts. Then, the adhesive tape was peeled off quickly. The maximum width (one side) of the coating adhered to the stripped adhesive tape was measured.

A: 0 mm
B: less than 2 mm
C: 2 mm to 5 mm
D: no less than 5 mm

Cycle Corrosion Test (CCT)

After forming the 20 μm electrodeposition coated film on the test plate, the edge and back face was sealed with tape, thereby providing cross cuttings that reached to the metal basis material. A 5% aqueous sodium chloride solution incubated at 35° C. was continuously sprayed for 2 hours onto this sample in a salt spray tester kept at 35° C., and with a humidity of 95%. Subsequently, it was dried under conditions of 60° C. and with a humidity of 20 to 30% for 4 hours. Such a sequence of procedures repeated three times in 24 hours was defined as one cycle, and 200 cycles were carried out. Thereafter, the width of the swelling portion of the coated film (both sides) was measured.

A: less than 6 mm

B: 6 to 8 mm

C: 8 mm to 10 mm

D: no less than 10 mm

Salt Spray Test (SST)

After forming the 20 μm electrodeposition coated film on the test plate, the edge and the back face were sealed with a tape, thereby providing cross cuttings that reached to the metal basis material. A 5% aqueous sodium chloride solution incubated at 35° C. was continuously sprayed for 840 hours to this sample in a salt spray tester kept at 35° C., and with a humidity of 95%. After washing with water and air drying, an adhesive tape "L-PACK LP-24" (trade name, manufactured by Nichiban Co., Ltd.) was adhered on the portion including the cuts. Then, the adhesive tape was peeled off quickly. The maximum width (one side) of the coating adhered to the stripped adhesive tape was measured.

A: less than 2 mm

B: 2 mm to 5 mm

C: no less than 5 mm

The evaluation results are summarized in Tables 4 to 6.

TABLE 4

| | Coating film amount | | | | Observation | Throwing power (%) | | Difference in coating | Appearance | | | |
|---|---|---|---|---|---|---|---|---|---|---|---|---|
| | Zr | Si | Cu | In, Al, Sn | of sludge | 210 V | 160 V | voltage (V) | of coating | SDT | CCT | SST |
| Example 1 | 44 | | 5.1 | 12 | B | 61 | 51 | 30 | A | — | A | A |
| Example 2 | 45 | 3.2 | 3.3 | 0.2 | B | 59 | 28 | 40 | B | A | A | A |
| Example 3 | 38 | | 2.5 | 15 | B | 54 | 45 | 40 | A | B | A | A |
| Example 4 | 48 | 5.2 | 2.2 | 8 | B | 56 | 54 | 40 | A | A | A | A |
| Example 5 | 51 | 5.5 | 6 | 7 | A | 58 | 53 | 20 | A | A | A | A |
| Example 6 | 55 | 3.3 | 1.8 | — | B | 56 | 31 | 40 | A | B | A | A |
| Example 7 | 66 | 5.2 | 15 | 28 | B | 59 | 51 | 20 | A | B | A | A |
| Example 8 | 44 | 3.4 | 6.6 | — | B | 55 | 34 | 40 | A | B | A | A |
| Example 9 | 62 | 4.6 | 11 | 21 | B | 61 | 49 | 30 | A | A | A | A |
| Example 10 | 66 | 5.2 | 16 | 22 | B | 52 | 44 | 20 | A | B | A | A |
| Example 11 | 34 | 2.4 | 2.2 | 11 | B | 62 | 51 | 20 | A | A | A | A |
| Example 12 | 33 | 2.2 | 11 | 18 | B | 55 | 48 | 30 | A | B | A | A |
| Example 13 | 88 | 6.3 | 18 | 28 | B | 55 | 38 | 40 | B | B | A | A |
| Example 14 | 83 | 6 | 3.1 | 18 | B | 52 | 28 | 40 | B | B | B | A |
| Example 15 | 40 | 2.8 | 38 | 12 | B | 59 | 44 | 20 | A | B | A | A |
| Example 16 | 51 | 3.6 | 3.8 | 2.5 | B | 53 | 27 | 40 | B | A | A | A |
| Example 17 | 55 | 3.6 | 5.2 | 6 | B | 55 | 31 | 40 | A | A | A | A |
| Example 18 | 28 | 2.3 | 10 | 18 | B | 61 | 55 | 20 | A | B | A | A |
| Example 19 | 45 | 2 | 9 | 4 | B | 55 | 47 | 20 | A | A | B | A |
| Example 20 | 38 | 1.1 | 2.5 | 8 | B | 52 | 37 | 40 | A | A | A | A |
| Example 21 | 39 | 2.2 | 1.8 | 11 | B | 55 | 35 | 40 | A | B | A | A |
| Example 22 | 27 | 2.5 | 2.8 | 7 | B | 54 | 31 | 40 | A | B | A | A |
| Example 23 | 32 | 2.3 | 4.3 | Al (0.2) Sn (12.5) | B | 57 | 47 | 20 | A | B | A | A |
| Example 24 | 28 | — | 4.1 | Al (0.3) Sn (11.8) | B | 54 | 42 | 20 | A | B | B | A |
| Example 25 | 25 | — | 5.1 | Al (0.2) Sn (13.9) | B | 5b2 | 43 | 20 | A | B | A | A |
| Example 26 | 25 | — | 5.1 | Al (0.2) Sn (13.9) | B | 54 | 45 | 20 | A | B | B | A |
| Example 27 | 55 | — | 5.2 | Sn (12.1) | B | 53 | 42 | 20 | A | A | A | A |
| Example 28 | 35 | — | 0.9 | Sn (13.4) | B | 53 | 43 | 20 | A | B | A | A |
| Example 29 | 62 | — | 35 | Sn (18) Al (1.2) | B | 60 | 50 | 30 | A | B | A | A |

TABLE 5

| | Coating film amount | | | | Observation | Throwing power (%) | | Difference in coating | Appearance | | | |
|---|---|---|---|---|---|---|---|---|---|---|---|---|
| | Zr | Si | Cu | In, Al, Sn | of sludge | 210 V | 160 V | voltage (V) | of coating | SDT | CCT | SST |
| Example 30 | 41 | | 3.1 | 0.8 | B | 59 | 28 | 40 | B | C | A | A |
| Example 31 | 40 | | 2.2 | 13 | B | 54 | 45 | 40 | A | C | A | A |
| Example 32 | 45 | | 2.6 | 9 | B | 56 | 54 | 40 | A | C | A | A |
| Example 33 | 52 | | 6.9 | 6 | A | 58 | 53 | 20 | A | C | A | A |
| Example 34 | 55 | | 2.1 | — | B | 56 | 31 | 40 | A | C | A | A |
| Example 35 | 62 | | 17 | 29 | B | 59 | 51 | 20 | A | C | A | A |
| Example 36 | 42 | | 6.9 | — | B | 55 | 34 | 40 | A | C | A | A |
| Example 37 | 60 | | 12 | 25 | B | 61 | 49 | 30 | A | C | A | A |
| Example 38 | 68 | | 18 | 22 | B | 52 | 44 | 20 | A | C | A | A |
| Example 39 | 34 | | 2.5 | 16 | B | 62 | 51 | 20 | A | C | A | A |
| Example 40 | 34 | | 16 | 17 | B | 55 | 48 | 30 | A | C | A | A |
| Example 41 | 83 | | 21 | 26 | B | 55 | 38 | 40 | B | C | A | A |
| Example 42 | 79 | | 3.3 | 19 | B | 52 | 28 | 40 | B | C | B | A |
| Example 43 | 44 | | 42 | 14 | B | 59 | 44 | 20 | A | C | A | A |
| Example 44 | 55 | | 2.6 | 2.8 | B | 53 | 27 | 40 | B | C | A | A |

TABLE 5-continued

| | Coating film amount | | | | Observation | Throwing power (%) | | Difference in coating | Appearance | | | |
|---|---|---|---|---|---|---|---|---|---|---|---|---|
| | Zr | Si | Cu | In, Al, Sn | of sludge | 210 V | 160 V | voltage (V) | of coating | SDT | CCT | SST |
| Example 45 | 58 | | 5.5 | 6.9 | B | 55 | 31 | 40 | A | C | A | A |
| Example 46 | 31 | | 12 | 21 | B | 61 | 55 | 20 | A | C | A | A |
| Example 47 | 44 | | 10 | 5 | B | 55 | 47 | 20 | A | C | B | A |
| Example 48 | 36 | | 2.7 | 8 | B | 52 | 37 | 40 | A | C | A | A |
| Example 49 | 36 | | 1.9 | 14 | B | 55 | 35 | 40 | A | C | A | A |
| Example 50 | 29 | | 2.7 | 8 | B | 54 | 31 | 40 | A | C | A | A |
| Example 51 | 32 | 2.3 | 4.3 | Al (0.2) Sn (12.5) | B | 57 | 47 | 20 | A | C | A | A |
| Example 52 | 28 | — | 4.1 | Al (0.3) Sn (11.8) | B | 54 | 42 | 20 | A | C | B | A |
| Example 53 | 25 | — | 5.1 | Al (0.2) Sn (13.9) | B | 52 | 43 | 20 | A | C | A | A |
| Example 54 | 25 | — | 5.1 | Al (0.2) Sn (13.9) | B | 54 | 45 | 20 | A | C | B | A |
| Example 55 | 55 | — | 5.2 | Sn (12.1) | B | 53 | 42 | 20 | A | C | A | A |
| Example 56 | 35 | — | 0.9 | Sn (13.4) | B | 53 | 43 | 20 | A | C | A | A |
| Example 57 | 65 | — | 36 | Sn (19) Al (0.8) | B | 62 | 53 | 30 | B | C | A | A |
| Example 58 | 61 | — | 32 | Sn (17.5) Al (1.1) | B | 60 | 52 | 30 | B | C | A | A |

TABLE 6

| | Coating film amount | | | | Observation | Throwing power (%) | | Difference in coating | Coating | | | |
|---|---|---|---|---|---|---|---|---|---|---|---|---|
| | Zr | Si | Cu | In, Al, Sn | of sludge | 210 V | 160 V | voltage (V) | appearance | SDT | CCT | SST |
| Comparative Example 1 | 52 | 3.5 | | | B | 21 | 12 | 80 | C | B | C | A |
| Comparative Example 2 | 48 | 3.2 | | — | B | 21 | 14 | 80 | C | B | C | A |
| Comparative Example 3 | 55 | 3.2 | 48 | | B | 39 | 19 | 40 | B | D | A | B |
| Comparative Example 4 | 1.8 | 0.1 | 1.2 | 0.2 | — | 55 | 43 | 30 | B | D | D | C |
| Comparative Example 5 | 0 | 0 | 0 | 0 | — | 38 | — | — | D | D | D | C |

INDUSTRIAL APPLICABILITY

The metal surface treatment liquid for cation electrodeposition coating of the present invention is applicable to metal base materials, such as automobile bodies and parts to be subjected to cation electrodeposition.

The invention claimed is:

1. A metal surface treatment liquid for cation electrodeposition coating which comprises zirconium ions, copper ions and other metal ions, and has a pH of 1.5 to 6.5, wherein:

the other metal ions are at least one selected from the group consisting of tin ions, indium ions, aluminum ions, niobium ions, tantalum ions, yttrium ions and cerium ions;

the concentration of zirconium ions is in the range of 10 to 10,000 ppm;

the concentration ratio of the copper ions to the zirconium ions is in the range of 0.005 to 1 on a mass basis; and the concentration ratio of the other metal ions to the copper ions is in the range of 0.1 to 1,000 on a mass basis; and further comprising a hydrolysis condensate of aminosilane.

2. A metal surface treatment liquid for cation electrodeposition coating according to claim 1, wherein said other metal ions are tin ions and/or aluminum ions.

3. A metal surface treatment liquid for cation electrodeposition coating according to claim 1 further comprising a fluorine ion, wherein the amount of the free fluorine ion at a pH of 3.0 is in the range of 0.1 to 50 ppm.

4. A metal surface treatment liquid for cation electrodeposition coating according to claim 1 further comprising a chelate compound.

* * * * *